US008695554B2

(12) United States Patent
McKeown

(10) Patent No.: US 8,695,554 B2
(45) Date of Patent: Apr. 15, 2014

(54) FORCED AIR VALVE GUIDE FOR AN INTERNAL COMBUSTION ENGINE

(76) Inventor: Murray McKeown, Surrey (CA)

( * ) Notice: Subject to any disclaimer, the term of this patent is extended or adjusted under 35 U.S.C. 154(b) by 149 days.

(21) Appl. No.: 13/095,268

(22) Filed: Apr. 27, 2011

(65) Prior Publication Data

US 2011/0297112 A1 Dec. 8, 2011

Related U.S. Application Data

(60) Provisional application No. 61/350,948, filed on Jun. 3, 2010.

(51) Int. Cl.
*F01L 3/00* (2006.01)
*F02B 25/00* (2006.01)

(52) U.S. Cl.
USPC ..... 123/188.9; 123/76

(58) Field of Classification Search
USPC ..... 123/188.6–188.9, 76
See application file for complete search history.

(56) References Cited

U.S. PATENT DOCUMENTS

| | | | | |
|---|---|---|---|---|
| 2,819,704 | A * | 1/1958 | Niederman | 123/41.17 |
| 3,116,596 | A | 1/1964 | Etal | |
| 3,522,702 | A | 8/1970 | Grosseau | |
| 3,948,229 | A | 4/1976 | Abthoff | |
| 4,149,493 | A * | 4/1979 | Franke | 123/26 |
| 4,232,641 | A * | 11/1980 | Curtil | 123/76 |
| 6,167,700 | B1 | 1/2001 | Lampert | |

* cited by examiner

*Primary Examiner* — Lindsay Low
*Assistant Examiner* — Syed O Hasan
(74) *Attorney, Agent, or Firm* — Global Intellectual Property Agency, LLC

(57) ABSTRACT

Disclosed is a modified valve guide for a four-stroke internal combustion engine that utilizes compressed air to accelerate outflow of exhaust gases from a combustion chamber and through the exhaust manifold. The device comprises a ported valve guide that is concentrically mounted about an exhaust valve stem. The valve guide is a hollow cylinder that surrounds the exhaust valve stem, and includes a vertically mounted port on its working end. Below the port is a circumferential ring and guide tube connection that accepts compressed air input, communicating forced air through the valve guide port on its working end into the combustion chamber and exhaust manifold. The introduction of forced air increases volumetric efficiency of the system by improving scavenging and forcibly removing exhaust gases from the cylinder during the exhaust stroke. Both the power and efficiency of the engine are improved, along with reduced emissions from the engine exhaust.

8 Claims, 4 Drawing Sheets

FORCED AIR VALVE GUIDE FOR AN INTERNAL COMBUSTION ENGINE

CROSS REFERENCE TO RELATED APPLICATION

This application claims the benefit of U.S. Provisional Application No. 61/350,948 filed on Jun. 3, 2010, entitled "Chamber Venting Valve."

BACKGROUND OF THE INVENTION

1. Field of the Invention

The present invention relates to four stroke internal combustion engines and exhaust gas scavenging. More specifically, the present invention pertains to an improved exhaust port venting system in which exhaust valve guides are fitted with a compressed air functionality that forces air into the combustion chamber, accelerating the outflow of exhaust gases and promoting their exit through the exhaust manifold.

An internal combustion engine is akin to an air pump, in which air is pumped into a combustion chamber, compressed with atomized fuel by a piston-cylinder device, ignited and then exhausted from the chamber. The intake and exhaust of gases is accomplished by a series of valves that open and close at predetermined times in the piston cycle. Four stroke combustion engines, in particular, are internal combustion engines that comprise one power stroke for every four strokes of the piston. The four strokes of these engines are the intake stroke, the compression stroke, the combustion stroke, and finally the exhaust stroke. Air and fuel are brought into the cylinder during the intake stroke, compressed and ignited during the compression stroke, burned and expanded during the combustion stroke, and then combustion byproducts are exited from the cylinder during the exhaust stroke.

The volumetric efficiency of an internal combustion engine is measured as the ratio of fuel and air that actually enters a combustion cylinder during intake to the capacity thereof under static conditions. Volumetric efficiency measures the efficiency with which air can be move through an engine, with higher values leading to more powerful and more efficient engines. Higher amounts and uninterrupted passage of air through the engine provides for higher quantities of fuel that can be added, and in turn produce a higher power output. Volumetric efficiency can be improved through several means, including larger valves or an increased quantity of valves for improved passage of air and fuel, application of secondary induction systems like turbochargers and superchargers which force air into the cylinders, or improved intake manifolds that streamline the ports of an engine for smoother air flow. Still other systems focus solely on clearing exhaust gases from the combustion chamber and exhaust manifold after combustion to reduce back pressure or stalling of air within the exhaust manifold.

The process of drawing in fresh air into and removing exhaust gases from a combustion chamber is known as scavenging. During the exhaust stroke, the piston reduces the volume in the cylinder as it advances from bottom dead center (BOC) to top dead center (TOC). As the volume within the cylinder reduces, its contents become compressed, manifesting in a pressure on the exhaust gas that forces it from the cylinder through an open exhaust valve. Engine timing systems control the opening and closing of the valves as the cylinder advances through its four strokes. The path from intake to exhaust must be kept in sync to utilize the full potential of the engine's power and efficiency.

It is sometimes common for an engine to insufficiently clear the exhaust gases from a cylinder during the exhaust stroke. Conventional engine timing systems may not operate with 100% efficiency, especially during times of high back-pressure in the exhaust system, which retards the air flow out of the engine prior to the beginning of the next intake stroke. A common method of treating this deficiency includes reducing the head loss or drag within the exhaust system, including making its path a more free-flow design. Removing emission systems and muffling means from the exhaust system have been used in closed-course racing, however these solutions are not suitable for commercial use, where everyday driving introduces considerable emissions into the atmosphere and the noise generated from an unmuffled engine is not appropriate in most settings.

Still other methods are directed at increasing the flow of exhaust gases from the cylinder, the exhaust manifold or the exhaust system. The present invention is an engine component that is specifically designed to compensate for a deficiency in removing exhaust gases from a cylinder and exhaust manifold, without the drawbacks related to removing exhaust and emissions components. The present invention is designed to be installed within any four-stroke internal combustion engine, and functions by forcibly removing exhaust gases from an engine cylinder during the exhaust stroke. The device utilizes a modified valve guide that delivers compressed air into the combustion chamber directly under the exhaust valve. The exhaust is thoroughly vented from the system by the introduction of pressurized air, as the compressed air forces the exhaust gas through the exhaust port and through the exhaust manifold prior to the exhaust valve reclosing.

2. Description of the Prior Art

Several devices have been disclosed in the art that attempt to forcibly remove exhaust gases from an engine via compressed air or similar means. U.S. Pat. No. 6,167,700 to Lampert is one such device, in which a ram air port is disclosed for capturing outside air through an intake, compressing it through a nozzle, and combining it with exhaust gases exiting a cylinder via a plenum chamber. This device discloses a system that is utilized downstream of the engine exhaust ports, along the exhaust pipes prior to entering the catalytic converter and muffler. While it may be useful for efficiently moving air through an exhaust pipe, its structure and intent is sufficiently different from the present invention. The forced air is captured from ambient air rushing passed the moving vehicle, as opposed to a system utilizing on-demand compressed air to force out exhaust gases from an engine cylinder.

U.S. Pat. No. 3,522,702 to Grosseau is a system more closely related to the present invention, wherein an air pump and associated pipeline is provided to inject air into the exhaust manifold of an engine to purify exhaust gases as they exit the engine. The system promotes efficient conversion of carbon monoxide (CO) in to carbon dioxide ($CO_2$) as the exhaust gases leave the manifold and enter the catalytic converter. While this system utilizes compressed air, its placement is within the exhaust manifold, and its structure significantly diverges from the present invention, wherein an exhaust valve guide is utilized to introduce compressed air. The present invention allows efficient airflow through the cylinder as the piston reaches top dead center and when the exhaust port is open. This aids in the pressurization and circulation of the exhaust gases, and allows efficient evacuation thereof through an open exhaust port or ports.

U.S. Pat. No. 3,948,229 to Abthoff describes a specifically designed intake and suction manifold for controlling the air flow through a v-shaped cylinder block engine. Similar to the Grosseau patent, the Abthoff patent relies on a forced air supply that forces air into the exhaust manifold for aiding escaping exhaust gases, rather than one that introduces the compressed air from a valve seat into the engine cylinder.

U.S. Pat. No. 3,116,596 to Boehme is another exhaust flow devices that describes a specifically designed flywheel that supplies air induction into an exhaust system downstream from an engine block. While this air induction system is useful for improving airflow through an exhaust system and preventing back pressure, the structure of the device and its installation are considerably different from the present invention. The air induction is supplied farther downstream than the engine exhaust valves, which are situated adjacent to the engine cylinders within the engine block.

The devices disclosed in the prior art involve improving air flow through an exhaust system, starting from the exhaust manifold through the exhaust system. The primary function of these devices and the field of the invention pertain to efficient flow of air through an engine, and efficient evacuation of exhaust gases. These devices may improve downstream flow in an exhaust and aid in relieving backpressure on the system; however they are not suited for thoroughly discharging exhaust gases directly from an engine cylinder for evacuation into the exhaust manifold. They rely on devices that improve air circulation, suction or pressure to draw gases away from an exhaust manifold, while the present invention is seated directly below the exhaust valves and delivers compressed air during the exhaust stroke to drastically improve evacuation of gases. This provides a clean combustion chamber prior to the initiation of the intake stroke, wherein a fresh charge of air and fuel are brought back into the cylinder prior to combustion. By removing unburned fuel and combustion byproducts from the cylinder, the engine can operate more efficiently. The improved flow from intake to exhaust also increases the amount of air that can be introduced in the intake charge, resulting in higher amounts of fuel and added power. Overall, the volumetric efficiency of the system is considerably improved, as air is efficiently removed from the engine cylinders during an exhaust stroke prior to intake of a fresh charge.

In this way, the present invention substantially diverges in design elements from the prior art. Consequently it is clear that that present invention is not described by the art and that a need exists for an improved forced air exhaust system that provides efficient evacuation of exhaust gases via compressed air delivered through a modified valve guide device. In this regard the instant invention substantially fulfills these needs.

SUMMARY OF THE INVENTION

In view of the foregoing disadvantages inherent in the known types of forced air exhaust systems now present in the prior art, the present invention provides a new forced air exhaust system wherein the same can be utilized for providing convenience for the user when utilizing compressed air to forcibly remove exhaust gases from an internal combustion cylinder.

It is therefore an object of the present invention to provide a modified valve guide device with a working end and a body structure that accepts an exhaust valve stem and circumferentially mates thereto. The working end of the valve guide includes a port for forcibly introducing compressed air into an engine cylinder when the exhaust valve is lifted and the exhaust port is open.

Another object of the present invention is to provide a modified valve guide device with a working end that is flushly mated with the underside of an exhaust valve and its stem when the valve is seated.

Another object of the present invention is to provide a device that improves scavenging during an exhaust stroke, promoting efficient evacuation of exhaust gases from the engine cylinder, and consequently an improvement in volumetric efficiency.

Another object of the present invention is to provide a compressed air system that is ties to the modified valve sleeve for introducing compressed air into an engine cylinder during the exhaust stroke, and one that operates continuously or on-demand as necessary.

Another object of the present invention is to provide an simple engine venting device and system that requires minimal modification to incorporate into existing engine designs, and one that allows adequate lubrication of the valve stem when installed.

Yet another object of the present invention is to provide a valve guide venting device comprised of a material that is designed to withstand the intense thermal cycling introduced by its proximity to the combustion chamber, and one that does not expand or contract beyond a limit that interferes with exhaust valve operation.

Finally, it is an object of the present invention to provide a new and improved valve guide venting device that has all of the advantages of the prior art and none of the disadvantages.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
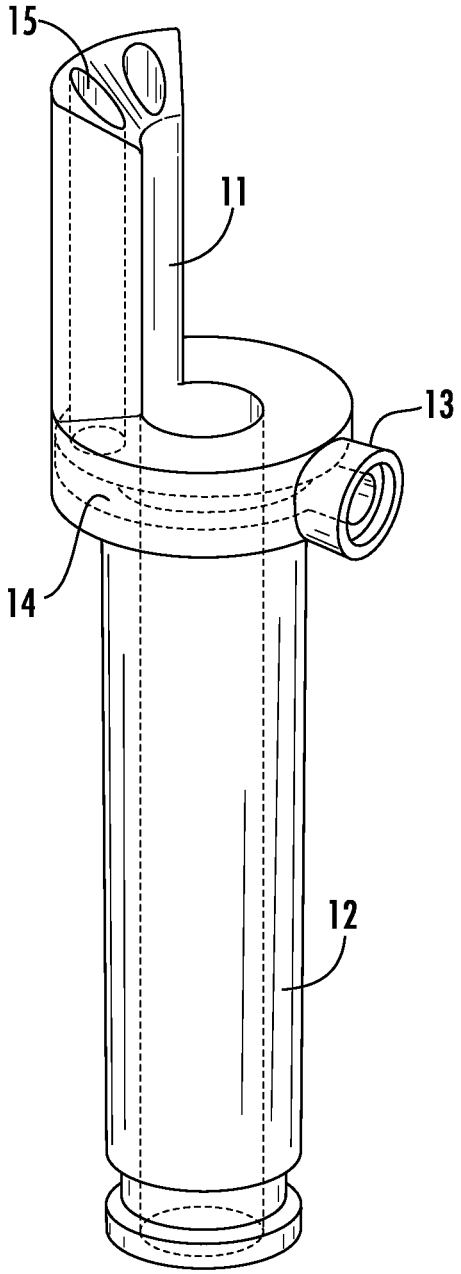
FIG. 1 shows a perspective view of the present invention, including the body of the valve guide, its working end and compressed air inlet.

Referring now to FIG. 1, there is shown a perspective view of the present invention, which comprises a modified exhaust valve guide with a working end 11 and a sleeve body 12. The guide is designed to integrally fit around and below an exhaust valve within the block of an internal combustion engine. The body 12 is seated circumferentially about the exhaust valve stem, while the working end 11 of the guide rests against the base of the valve head. A compressed air inlet port 13 is provided along a shelf region of the guide, wherein compressed air is forced into the inlet port 13 and into the cavity 14 of the shelf. The cavity 14 is an enclosed structure that is either welded or otherwise sealed to allow air flow from the inlet port 13, around the shelf region and up through ports 15 within the working end 11 of the valve guide.

Air is continually fed into the inlet port 13 and held within the guide while the exhaust valve is seated in its closed position. When the exhaust valve is seated and the exhaust port is closed, the base of the exhaust valve mounts flush against the ports 15 on the working end 11 of the valve guide and prevents leakage of compressed air. When the exhaust valve is pushed into its working position, opening the exhaust port by way of a rotating cam device, the base of the valve is forced away from the ports 15 and the internal compressed air is released from the guide tube and into the engine cylinder.

The device is a once piece construction, with air inlet port 13 and the shelf region attached and enclosed with a layer of welding. The enclosure provides a pathway for the compressed air, starting from the inlet 13, extending around the shelf and up through the ports 15. The enclosed air supply prevents interaction with oil lubrication of the valve stem. The pressure from the compressed air is contained, rather than forced along the valve stem. This prevents any pressure from forcing lubrication away from the valve stem or interfering with factory oiling design. Without an enclosure, air pressure would inhibit oiling of the guide as the oil would not enter the valve stem oil seal that controls lubrication of the assembly.

Figure 2:
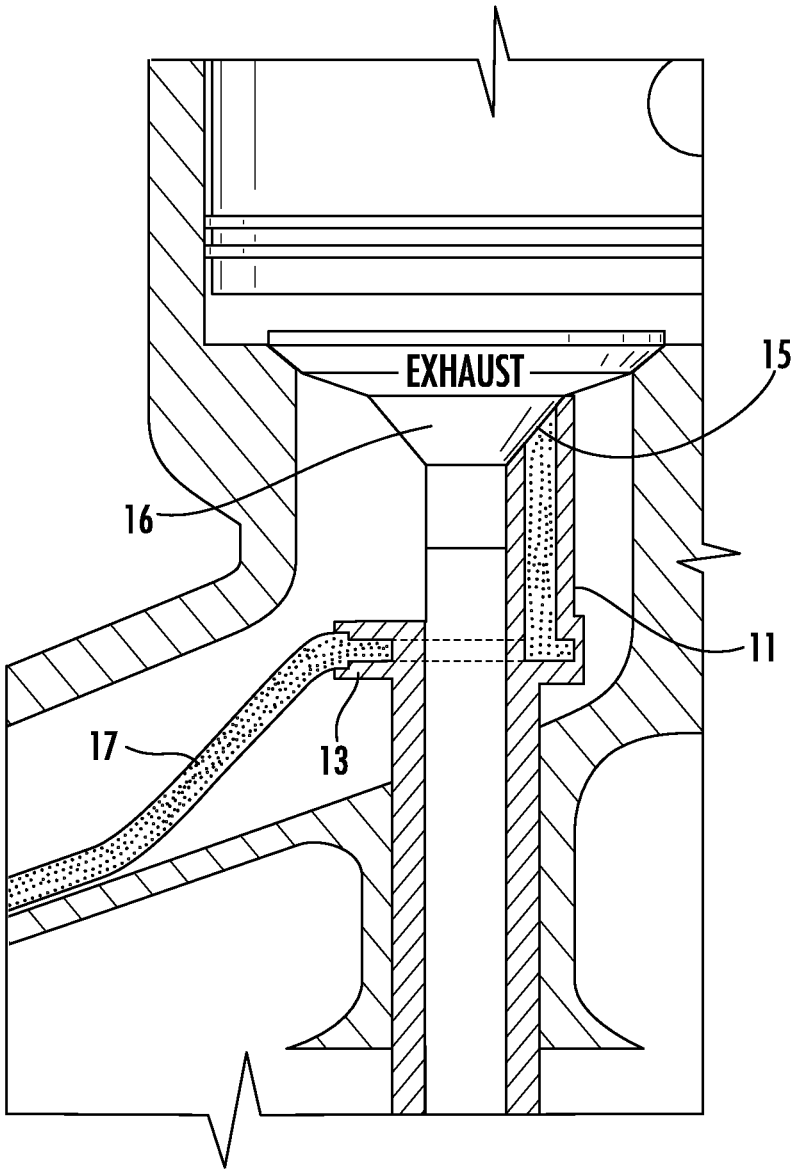
FIG. 2 shows a cross section side view of the present invention in its working position, positioned within an engine block and surrounding an exhaust valve.

Referring now to FIG. 2, there is shown a cross section side view of the valve guide in its working position below an exhaust valve 16 in its seated position. The guide is positioned around the exhaust valve stem, similar to a standard valve guide. The working end 11 of the valve guide is modified from a standard guide to accept compressed air functionality. Compressed air is fed from a feed line 17 to the air inlet port 13 of the guide. Once the air passes the inlet port 13, it circulates around a shelf region and up through the working end 11 of the guide. Ports 15 along the working end 11 allow the air to exit at a high pressure when the exhaust valve 16 is moved into its working position and lifted above its seated position. In its seated position, as shown in FIG. 2, the base of the valve 16 closes the outlet ports 15 on the valve guide, preventing any air leakage. The base of the valve 16 mounts flush against the ports 15, which may require modified valve 16 or a specifically designed guide working end 11.

Figure 3:
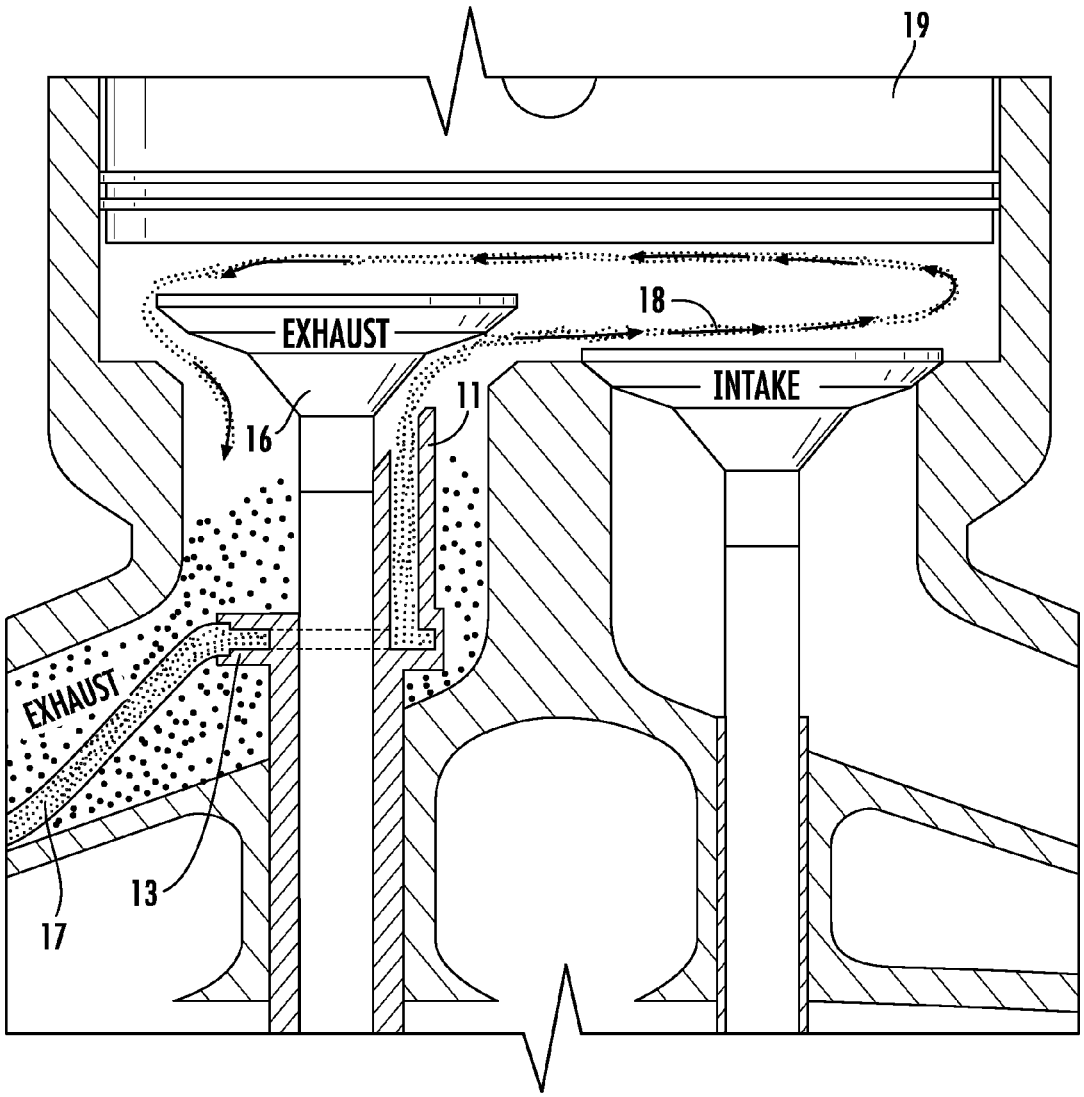
FIG. 3 shows a cross section side view of the present invention again in its working position within an engine block, and in its working state.

Referring now to FIG. 3, there is shown another cross section side view of the valve guide device in its working position within an engine block and in its working state. This figure illustrates the function of the present invention, highlighting the device in its working state. During the exhaust stroke of the engine, the exhaust valve 16 is lifted from its seated position into its working position. This opens the exhaust port and allows exhaust gases to exit the cylinder while the piston 19 reaches top dead center. Once the exhaust valve 16 is lifted, the ports along the working end 11 of the valve guide are opened, allowing a jet of compressed air to enter the engine cylinder and circulate 18 the exhaust gases. Air is supplied via a compressed air feed line 17 to the air inlet port 13 along the shelf of the valve guide. Air circulates around the shelf and up through the working end 11, exiting into the cylinder when the valve 16 is lifted.

Once the jet of compressed air is introduced into the cylinder, the exhaust gases are further pressurized and circulated 18 within the cylinder and forced out of the open exhaust port or ports. The exhaust gases are rapidly and efficiently evacuated from the cylinder, not only from the compression induced by the approaching piston, but also the compressed air introduction. The exhaust exits the cylinder and enters the exhaust manifold just prior to the exhaust valve 16 reseating on the exhaust port and sealing off the two chambers. Exhaust gases are efficiently removed from the cylinder to allow a fresh charge of air and fuel to be drawn into the cylinder during the proceeding intake stroke.

Figure 4:
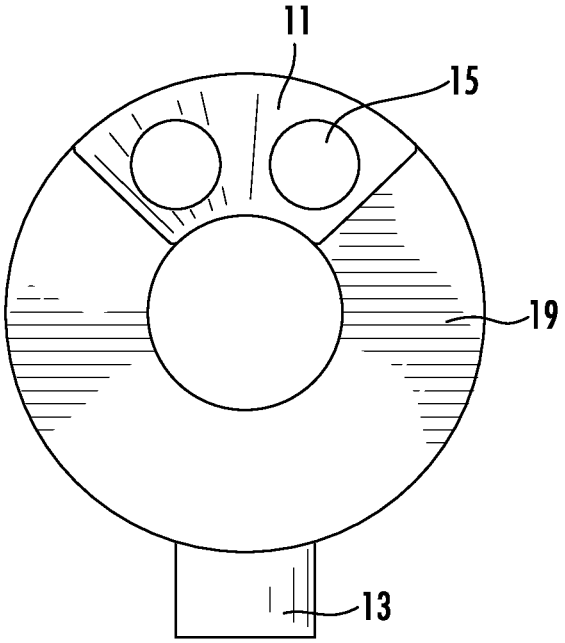
FIG. 4 shows an overhead view of the present invention.

Referring now to FIG. 4, there is shown an overhead view of the present invention. A plurality of ports 15 run through the working end 11 of the valve guide, extending vertically from the shelf region 19. Within the shelf 19 is an enclosed cavity that connects an air inlet port 13 to the ports 15 along the working end 15. The cavity allows air flow around the valve guide, and is enclosed with a layer for weld or similar air tight enclosure means that one skilled in the art would utilize.

In use the device replaces a standard exhaust valve guide within an internal combustion engine. A compressed air system, located within the vehicle and powered thereon, provides pressurized air from a pressure vessel to the valve guides. A feed line is provided that connects the compressed air to the valve guide, which can either sit in the exhaust manifold or be build into the engine block for a more advanced design. The system provides a forced air exhaust system that clears out combustion cylinders during an exhaust stroke, and one that can be retrofitted onto existing engines or designed into a new engine block.

The number of valve guides placed within the engine is dependent upon the user preference and the number of valves per cylinder. At least one compressed air guide valve should be present per cylinder to achieve efficient evacuation of each cylinder. Likewise, the location of the air inlet port along the valve guide may be oriented to accommodate different exhaust manifold and engine block geometries. This provides modularity, especially when incorporating the disclosed invention onto an existing engine without modification.

The compressed air system may run as an auxiliary system, drawing power directly from the engine in the form of a belt and pulley, or from a draw of the onboard electrical system. The type of system is dependent upon user application and preferences. The system is parasitic on either the engine output or the electrical system, but provides increases in volumetric efficiency that may compensate for any loss in efficiency. Increased power of the engine may also be a desired effect, in which a small drag on the electrical system or from a belt-driven auxiliary system may not be a concern.

Pressure from the compressed air system is fed continuously as the engine cycles through its different strokes. When a particular exhaust valve is lifted, air is fed into that cylinder for a period of time defined by the cam timing that controls the valve motion. The air system must be sufficient to accommodate any drops in pressure as a result of the constant opening and closing of valves along the cylinder bank.

The air inlet port, the enclosed air cavity and the ports along the working end of the guide comprise an air guide means. The structure of the air guide means may incorporate any means to communicate air from a compressed air feed line, through the valve guide and into the cylinder when the exhaust valve is lifted. Alternative embodiments of the air guide means may include variations in structure and design of an air tight enclosure, or specific tailoring of the ports. It is not desired to limit these means to the illustrations show in FIG. 1 through FIG. 4. A primary requirement of the device is an air tight communication of compressed air through the valve guide, and one that does not force air around the valve stem oil seal or interfere with proper lubrication of the valve stem.

Finally, the material choice for the present invention must accommodate the intense thermal cycling that occurs in this region of the engine. The close proximity of the valve guides to the combustion chamber results in very high temperature spikes and thermal effects that can cause material to expand and contract based on thermal loads developed from conduction and friction loads.

In a preferred embodiment, the material choice for the present invention may include 347 stainless steel, UNS S34700. This steel alloy is a stabilized stainless steel which offers excellent resistance to intergranular corrosion following exposure to temperatures in the chromium carbide precipitation range of 800 to 1500° F. The material is stabilized by the addition of columbium and tantalum, and is advantageous for high temperature service because of its good mechanical properties. Alloy 347 stainless steel offers high creep and stress rupture properties, which might also be considered for exposures where sensitization and intergranular corrosion are concerns.

Although it is not desired to limit the present invention to this material type, this stainless steel has proven to withstand the thermal loading in an internal combustion chamber region while satisfactorily operating under required mechanical loads. Any material of adequate thermal and material properties may be substituted if deemed suitable by one skilled in the art.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compressed air cylindrical valve guide for an internal combustion engine, comprising:

a cylindrical valve guide comprising a valve guide body and a working end;

said valve guide body comprising a hollow central region adapted to accept the stem of a valve therethrough;

an air guide means along said valve guide body for accepting compressed air and guiding it through said cylindrical valve guide working end to at least one aperture;

said cylindrical valve guide working end being adapted to terminate flushly against the base of said valve when said valve is in a seated position;

when in use, said compressed air is blocked from exiting said cylindrical valve guide working end by said base of said valve while said valve is in a seated position, and said compressed air exits said cylindrical valve guide working end when said valve is lifted.

2. A device as in claim 1, wherein said air guide means comprises a shelf region between said valve guide body and said cylindrical valve guide working end, said shelf region forming a circumferential air enclosure about said valve guide body;

an air inlet port affixed to said shelf region for accepting compressed air;

said at least one aperture are vertical ports that communicate compressed air from said shelf region into an engine cylinder when in use and said valve is lifted from a seated position.

3. A device as in claim 1, wherein said cylindrical valve guide device comprises 347 stainless steel.

4. A device as in claim 1, wherein compressed air is fed into said air guide means via a feed line.

5. A device as in claim 4, wherein said feed line is run along said internal combustion engine exhaust manifold when in use.

6. A device as in claim 4, wherein said feed line is internal to said internal combustion engine block when in use.

7. A method of improving volumetric efficiency of an internal combustion engine, comprising the steps of:

supporting the stem of a valve of an internal combustion engine with a cylindrical valve guide having an air guide means for expelling compressed air from a working end of said cylindrical valve guide into an engine cylinder;

blocking said compressed air from being expelled from said working end of said cylindrical valve guide with the base of said valve when said valve is in a seated position against said cylindrical valve guide working end;

releasing said compressed air from said cylindrical valve guide working end directly into said engine cylinder when said valve is lifted away from said cylindrical valve guide working end during an exhaust stroke of an engine cycle.

8. A compressed air cylindrical valve guide for an internal combustion engine, comprising:

a cylindrical valve guide comprising a valve guide body and a working end;

said valve guide body comprising a hollow central region adapted to accept the stem of a valve therethrough;

an air guide means along said valve guide body adapted to accept compressed air and guide it through at least one aperture in said cylindrical valve guide working end;

wherein said cylindrical valve guide working end releases compressed air directly into an engine cylinder when said valve is in a lifted position.

* * * * *